US005922149A

United States Patent [19]

Mallen Herrero et al.

[11] Patent Number: 5,922,149

[45] Date of Patent: Jul. 13, 1999

[54] METHOD FOR MAKING STEEL WIRES AND SHAPED WIRES, AND USE THEREOF IN FLEXIBLE DUCTS

[75] Inventors: José Mallen Herrero; François Ropital, both of Paris; André Sugier, Cagnes sur Mer, all of France

[73] Assignees: Institut Francais du Petrole, Rueil Malmaison; Coflexip, Paris, both of France

[21] Appl. No.: 08/913,222

[22] PCT Filed: Mar. 8, 1996

[86] PCT No.: PCT/FR96/00363

§ 371 Date: Nov. 4, 1997

§ 102(e) Date: Nov. 4, 1997

[87] PCT Pub. No.: WO96/28575

PCT Pub. Date: Sep. 19, 1996

[30] Foreign Application Priority Data

Mar. 10, 1995 [FR] France ..... 95 03093

[51] Int. Cl.[6] ..... C21D 8/06; C21D 9/52; C22C 38/04; C22C 38/18

[52] U.S. Cl. ..... 148/598; 148/599; 148/602; 148/603; 148/320; 148/333

[58] Field of Search ..... 148/598, 599, 148/602, 603, 320, 333, 334, 335

[56] References Cited

U.S. PATENT DOCUMENTS 5,141,570 8/1992 Yutori et al. ..... 148/320

FOREIGN PATENT DOCUMENTS 2 661 194 10/1991 France .
53-56122 5/1978 Japan ..... 148/598
91 16461 10/1991 WIPO .

OTHER PUBLICATIONS

Patent Abstracts of Japan, 16(106), C–919, Mar. 16, 1992.
Patent Abstracts of Japan, 16(086), C–916, Mar. 3, 1992.
Patent Abstracts of Japan, 14(047), C–682, Jan. 29, 1990.

*Primary Examiner*—Deborah Yee
*Attorney, Agent, or Firm*—Millen, White, Zelano & Branigan, P.C.

[57] ABSTRACT

A method for making steel wires, wherein an elongate shaped wire is produced by rolling or drawing steel consisting of 0.05–0.5% C, 0.4–1.5% Mn, 0–2.5% Cr, 0.1–0.6% Si, 0–1% Mo, no more than 0.25% Ni, and no more than 0.02% S and P, and a first heat treatment is performed on the shaped wire, including at least one step of quenching under predetermined conditions to achieve an HRC hardness of at least 32, a predominately martensitic and bainitic steel structure and a small amount of ferrite. A shaped wire and a flexible tube for conveying an $H_2S$-containing effluent are disclosed.

31 Claims, No Drawings

METHOD FOR MAKING STEEL WIRES AND SHAPED WIRES, AND USE THEREOF IN FLEXIBLE DUCTS

FIELD OF THE INVENTION

This invention relates to elongated elements of great length, such as steel wires to reinforce hoses intended for transporting pressurized effluent. The invention relates to a process for the production of these reinforcement wires, the wires that are obtained by the process, and the hoses which contain such reinforcing wires in their structure.

BACKGROUND OF THE INVENTION

Applications are known in which hoses that are reinforced with armor layers that consist of steel wires are used to transport fluids, particularly hydrocarbons. In certain cases, these hoses are placed under conditions where they are subjected to a corrosive environment, for example, in the presence of acidic fluids that contain sulfurated products. Also, in case where such hoses are placed in very deep water, more and more they need to have very high mechanical performance levels in terms of resistance to internal pressure, to axial load, and to external pressure resulting from the great depth of immersion.

In the hoses, whereby sealing is ensured by one or more polymer sheaths, mechanical resistance to internal and external pressure and to external mechanical stresses is provided by one or more armor layers that consist of wires or steel sections that have a specific profile.

Generally, the hose comprises at least one of the following armor layers: a casing for resistance to external pressure that is made of wires or sections that are arranged at an angle of close to 90° relative to the axis, a layer for resistance to internal pressure (called an arch) that is arranged at an angle of greater than 55°, with the elongated elements of the casing and the arch preferably being wires that can be laced, and at least one tensile-strength armor layer that is wound at an angle of less than 55°. According to another method, the arch and the traction armor are replaced by two symmetrical armor layers that are wound at an angle of about 55°, or by two pairs of layers that are wound at 55°, or else by a set of at least two layers, with the winding angle of at least one layer being less than 55° and the winding angle of at least one another layer being greater than 55°. The steel of the wires that comprise the reinforcements is to be selected in such a way that these wires, taking into account their section, provide the mechanical strength that is necessary in service at the same time that they withstand corrosion, in particular in some cases in the presence of $H_2S$.

These steel wires, which are generally shaped by rolling or hot or cold drawing, can have different profiles, i.e., straight sections: approximately flat or a flat surface, shaped in a U, T, or Z, with or without means for hooking to an adjacent wire, or circular.

In the case where these products are used in the presence of acid gas, basically $H_2S$ and $CO_2$, in addition to generalized corrosion, problems can arise that are connected with the penetration of hydrogen into the steel. Actually, $H_2S$ (or rather the $HS^-$ ion) is a substance that inhibits the recombination of hydrogen atoms that are produced by reduction of protons at the surface of the steel. These hydrogen atoms are introduced inside the metal and recombine there, thus giving rise to two types of deteriorations:

bubbles under the surface of the steel ("hydrogen blistering," we then speak of "blisters"), or internal cracking (called stepwise cracking) can appear in the absence of stress and can be aggravated in the presence of residual stress, an embrittlement that results in delayed ruptures in the case where the steel is put under stress (hydrogen stress corrosion).

NACE standards have been provided for evaluating the suitability of a steel structural element for use in the presence of $H_2S$. The steels should undergo a test on a representative specimen, under stress in an $H_2S$ environment with a pH of 2.8 to 3.4 (NACE Test Method TM 0177 pertaining to the results of stress cracking, commonly referred to as "Sulfide Stress Corrosion Cracking" or SSCC), in order for them to be considered usable in the production of metal structures that have to withstand the effects of corrosion under stress in the presence of $H_2S$.

Another NACE standard (TM 0284) relates to the effects of cracking that are induced by hydrogen, commonly referred to as "Hydrogen-Induced Cracking" or HIC. The test procedure that is recommended by the above standard consists in exposing specimens, without stress, to a sea water solution that is saturated with $H_2S$, at ambient temperature and ambient pressure, at a pH of between 4.8 and 5.4. The procedure then calls for carrying out metallographic examinations to quantify the cracking of the specimens or to demonstrate the absence of cracking. An additional criterion for evaluating specimen damage can be the determination of mechanical characteristics after an HIC test. This criterion does not appear in NACE standard TM 0284. Applicants have thus been led to define an additional evaluation method that consists in carrying out tensile strength tests on specimens to determine the mechanical characteristics after HIC and to compare these results with the mechanical characteristics before HIC. This method has proved to be particularly advantageous in the case of reinforcement wires that are the object by this invention, with these wires being subjected to conditions of uniaxial longitudinal stresses, by comparison with the walls of steel tubes, which tubes constitute the main application of the NACE standards. Another supplementary method consists in comparing necking loss values Z (%) before and after the HIC test, whereby the difference should be relatively small and preferably less than 30%.

With the conditions of drilling for underwater deposits having become tougher and tougher over time, it recently appeared that the qualification of the materials for their use in the presence of $H_2S$ should target the case of a more acidic environment, where the pH can be as low as about 3. It was thus specified that in certain cases the tests according to NACE standard TM 0284 should be carried out in a solution that is saturated with $H_2S$ that has a pH of, for example, 3 or 2.8, similar to the solution that is defined by NACE standard TM 0177, and no longer with a pH that is at least equal to 4.8.

According to the techniques that are currently known, the reinforcement wires of hoses, in particular for the case where fluids that contain $H_2S$ are being transported, are made with soft or medium-hard carbon-manganese steels (0.15 to 0.50% carbon) that have a ferrite-pearlite structure to which is applied, after the hot-rolled rods are cold-shaped, a suitable thermal annealing treatment to bring the hardness to the accepted value, if necessary.

NACE standard 0175 defines that such carbon-manganese steels are compatible with an $H_2S$ environment if they have a hardness of less than or equal to 22 HRC. It has thus been verified that reinforcement wires, as described above, made of carbon-manganese steel and having a ferrite-pearlite structure, can be produced by cold shaping, followed by annealing to meet the traditional NACE criteria. A process that is described in document FR-A-2661194 which makes it possible to obtain steel with a hardness of more than 22 HRC and is compatible with $H_2S$ according to NACE standards TM 0177 and TM 0284 is known, with the solution that is used for the tests according to TM 0284 having a pH of between 4.8 and 5.4.

On the other hand, it has been found that the carbon steels with a ferrite-pearlite structure are incapable of satisfactorily withstanding the HIC tests that are carried out according to the procedure of standard TM 0284 when these tests are carried out in a more acidic environment, for example with a pH on the order of 3, which corresponds to conditions now being encountered in certain cases in petroleum deposit mining. These unacceptable results were obtained even in the case where the final thermal treatment is more intense, so as to obtain an HRC hardness that is less than 22 HRC.

Therefore, in order to produce hose reinforcement wires, there is a need for a steel that, on the one hand, is compatible with $H_2S$ under the new conditions that are described above and that, on the other hand, have a composition and a process of production that are relatively standard and fairly low-tech in order to keep production costs sufficiently low.

Furthermore, the steels and the production processes that are used to produce hose reinforcement wires should be such that the shaping wire can be produced in very long continuous lengths, on the order of several hundreds of meters or several kilometers. The wire that is thus produced is wound in coils with a view to its later use to produce hose reinforcement layers. In addition, despite the very large unit lengths of the wires that are thus produced, it is important that they can be connected by welding during the reinforcement operation in the course of the production of the hose. To recreate, in the welding zone, the specified properties of the steel, in particular the resistance to $H_2S$, thermal treatment is to be provided after welding.

In the case where compatibility with $H_2S$ is not required (production of "sweet crude"), carbon steels in the cold-shaped raw state that also have a ferrite-pearlite structure but have considerably higher mechanical strength and hardness values are commonly used. It has been found, nevertheless, that increasing mechanical strength beyond certain limits causes such steels to have inadequate ductility, taking into account the preshaping and reinforcement operations that have to be carried out with the reinforcement wire.

SUMMARY OF THE INVENTION

The object of this invention is to describe a process for obtaining an elongated element of great length that is intended for the production of a hose, whereby the elongated element has optimized mechanical characteristics as well as, in an application according to the invention, good resistance to $H_2S$.

This invention relates to a process for the production of a steel shaping wire, whereby this wire is of great length and can be used as a hose reinforcement wire. The process comprises the following stages:

a shaping wire of great length is produced by rolling or drawing from a steel that contains the following elements:

from 0.05% to 0.8% of C, from 0.4% to 1.5% of Mn, preferably less than 1% of Mn, from 0 to 2.5% of Cr, between 0.25 and 1.3%, from 0.1% to 0.6% of Si, from 0 to 1% of Mo, at most 0.50% of Ni, at most 0.02% of S and P, and preferably S less than or equal to 0.005%, optionally with, in addition to the action of Si, deoxidizing with aluminum or silico-calcium, a thermal treatment that comprises at least one quenching operation is carried out on the shaping wire, optionally under conditions that are adjusted to obtain an HRC hardness that is greater than or equal to 32, and preferably greater than or equal to 35 and can advantageously reach or exceed 50, the structure of the steel of the shaping wire that is thus obtained is predominantly martensite-bainite.

The quantity of ferrite will preferably be small, in particular less than or equal to 10%, and advantageously less than or equal to 1%.

According to a variant of this invention, carbon content C can be greater than or equal to 0.08%, preferably greater than or equal to 0.12%, and the steel can contain at most 0.4% of Si.

The shaping wire can be produced by cold shaping, in particular by rolling or drawing from hot-rolled rods. It was possible to hot-roll the hot-rolled rods with monitored cooling, for example, of the STELMOR type, to achieve Rm values that are less than 850 MPa. In the case of hot-rolled rods that have an Rm value of greater than 850 MPa, it may be advantageous to subject them to annealing to soften the grade to Rm<850 MPa.

The shaping wire can also be obtained directly by hot rolling. In this case, the fracture stress Rm of the wire will preferably also be less than 850 MPa, either after rolling or after soft annealing to facilitate the operations involved in handling the elongated element, before or during quenching operations.

The process thus normally comprises a preliminary hot shaping stage, either of hot-rolled rods that are subsequently transformed into a shaping wire by cold shaping, or directly of a shaping wire. In both cases, the wire that is thus hot-formed has a predominantly ferrite-pearlite structure, but can comprise hard zones, such as martensite. Preferably, before any subsequent cold shaping operation and/or with quenching, the steel is to have a breaking point Rm that is less than 850 MPa, whereby this property can be obtained either immediately after hot shaping or through soft annealing treatment.

Preferably, the quenching operation can be carried out continuously in a bath.*

*The translation of "au défilé" could also be "in the constriction" (presumably a die) or perhaps in a bath rather than "in a stream". This translation will be checked with the inventor and corrected if necessary.

As a supplement to said quenching, the process can comprise thermal stress-relief annealing. In this case, the limitation that HRC hardness has to be greater than or equal to 32 and preferably greater than or equal to 35 is to be respected after the stress-relief annealing.

The stress-relief annealing can be carried out in a coil in a furnace.

The quenching and said stress-relief annealing can be carried out in a bath, preferably in a line, which makes it possible to produce the wires of very great length that are required for the production of hose reinforcement layers.

According to a first variant of this invention, carbon content C can be less than or equal to 0.45%, preferably less than or equal to 35%, and the steel contains at least one of the two following alloying elements, in a small quantity:

between 0.1% and 2.5% of Cr, preferably between 0.25 and 1.3%, between 0.1% and 1% of Mo, with the steel thus being of the low-alloyed type and being consistent with grades that are common in the industry and are of relatively limited cost.

Such a steel that contains a limited content of Cr and/or Mo can optionally not contain any other alloying element or dispersoid. The scope of this invention will not be exceeded, however, if the steel contains a little dispersoid, such as vanadium, titanium, or niobium, in particular for low-carbon steels, whereby the carbon content can be equal to or greater than 0.05%. In this case, the vanadium content can be limited to a small value to avoid too long an annealing period after welding; preferably the vanadium content will be less than or equal to 0.10%.

According to another variant of the invention, the carbon content of the steel can be greater than or equal to 0.4%, while staying below 0.8%, and can correspond to a standard hard or semi-hard carbon-manganese steel that is traditionally used in wire-drawing or cable-making, without the addition of an alloying element such as Cr or Mo. The steel can optionally contain a small quantity of dispersoid, as can commonly be found in commercial steels. Such steels can be in the steel range of FM40 to FM80, according to the AFNOR standard.

The quenching thermal treatment can comprise the passage into an austenitizing furnace at a temperature that is greater than point AC3 of the steel grade for wire, then into a zone for quenching in a fluid that has a quenching intensity which is matched to both the steel grade and the size of the wires, with the temperature and the dwell time being matched to the grade to obtain a grain size that is between indices 5 and 12, and advantageously between indices 8 and 11, according to standard NF 04102. The structure that is obtained after quenching can be predominantly martensite with a percentage of between 0 and 50% of lower bainite or predominately lower bainite with a percentage of between 0 and 50% martensite. Preferably, the bainite is in the lower bainite state rather than the higher bainite state. Preferably, the structure can contain only a small quantity of ferrite.

The process of production can end with the quenching operation, preferably followed by stress-relief annealing.

The temperatures of the stress-relief annealing can be:

in a bath between 300 and 550° C., with the speed being matched to the section of the wire to obtain a hardness, according to this invention, of greater than or equal to 32 HRC, in a coil in a furnace between 150 and 300° C.

It is possible that the wire that is thus obtained may not be suitable for withstanding $H_2S$ under certain operating conditions, but can be used in a very advantageous way as a reinforcement wire for hoses thanks to its excellent optimized mechanical properties, in particular by the combination of high mechanical strength and ductility that is better than can be obtained with the known processes. The breaking point Rm can reach 1000 to 1600 MPa, equal to or greater than that of the strongest reinforcement wires that are currently known, and the elongation at fracture can be greater than 5%, optionally greater than 10%, and may in some cases exceed 15%. Whereas for the known steel wires that have a strength level that is comparable to the cold-hardened state, the latter have an elongation at fracture that does not exceed 5%.

According to a particular implementation of the invention to obtain optimized shaping wires that withstand $H_2S$, the process can, after thermal quenching treatment optionally supplemented by stress-relief annealing, comprise a final thermal tempering treatment under specified conditions to obtain a hardness that is greater than or equal to 20 HRC and less than or equal to 35 HRC.

The conditions of the final tempering thermal treatment can be adapted in such a way as to obtain a hardness of less than or equal to 28 HRC, compatible with operating conditions that can call for an environment with a pH of close to 3.

In any case, after quenching and final tempering, as defined, including with a pH of close to 3, a steel according to this invention does not have blistering or cracking in HIC tests, and, in addition, does not have cracking when it is subjected to tests according to NACE standard 0177 (SSCC) with a tensile stress that is at least equal to 60% of the yield point and can reach about 90% of the latter.

Final tempering can be carried out in a bath, in a line, or separately.

Final tempering can be carried out in a coil in a furnace.

The tempering temperature can be at most equal to a temperature that is about 10° C. to 30° C lower than the AC1 temperature of the start of austenitization of the steel to avoid excessive coalescence of carbide, which can lead to impairment of its characteristics.

At the end of production, the wire is wound on a coil so that it can later be mounted on a coiling machine or winding machine for the production of reinforcement of the hose.

In general, especially to obtain the best possible mechanical strength characteristics, the steel grade can be optimized as a function of the process for shaping the shaping wire from the hot-rolled rods:

Shaping of the wire by cold transformation:

It has been found that this implementation of the invention makes it possible to obtain advantageous results by selecting a low-alloy steel, or steel of the carbon type.

The content of alloying elements, while being low, should be sufficient to obtain, after quenching, a predominantly martensite or bainite structure with little ferrite (it thus is possible, in the most favorable cases, to obtain a structure that contains close to 100% martensite and commonly at least 90% martensite and bainite).

Furthermore, the content of alloying elements should be limited to relatively low values. Actually, if this content exceeds certain limits (which can be determined by one skilled in the art by performing several successive tests), consequences result that make the wire unsuitable for cold transformation operations:

a) risk of formation of an excessive amount of martensite in the structure of the hot-rolled rods, by the simple effect of cooling following hot shaping of the hot-rolled rods, b) too high a hardness of the hot-rolled rods to be able to properly carry out cold rolling for transforming the hot-rolled rods into shaping wire according to the specified dimensions.

It has thus been found that it is possible, among steels that are too low-alloy and steels that are excessively alloyed, to find steels that have an optimized content of alloying elements in order to produce by cold rolling shaping wires with characteristics that are particularly advantageous after quenching and tempering.

Wire shaping by hot rolling:

This process makes it possible to reduce production costs. It also makes it possible to obtain wires for shaping larger sections than cold rolling.

The invention thus makes it possible to produce a shaping wire which, after quenching, has a predominantly martensite or bainite structure relatively homogeneously over the entire thickness of the wire, despite the increase in the thickness of the wire. It is thus possible to obtain, in the most favorable cases, up to about 100% martensite, with the total content of martensite and bainite commonly being at least equal to 90%.

Such a result is obtained by using a steel grade that is more alloyed than the steels that are recommended for shaping by cold rolling. Such steels that are more heavily alloyed would, moreover, have been difficult to use or even unsuitable for cold rolling.

According to the invention, it is possible, in particular, to produce shaping wires that have both high mechanical strength and excellent stability in the presence of $H_2S$ by cold transformation, even if the working induces global deformations or strong local deformations. This result is obtained even though a high level of cold deformation creates the risk, depending on the degree of deformation and the grade, of causing excessive increases in strength and a reduction in ductility that can lead to defects during subsequent shaping operations. According to a particular implementation, whereby the cold shaping comprises at least two successive stages of cold transformation, an intermediate operation of thermal treatment is carried out between the first and the last stage of cold transformation. For example, the intermediate operation of thermal treatment can be carried out between a preliminary operation of wire-drawing and the beginning of rolling, or between two successive rolling passes.

Such an intermediate thermal treatment can be achieved in various known ways of metallurgy, to lower the mechanical strength, preferably below 850 MPa, and to restore the ductility that makes cold transformation possible.

The invention also relates to a shaping wire with a constant section and great length that is suitable for use as a reinforcement wire of a hose, whereby said wire is produced from a steel that contains the following elements:

from 0.05% to 0.8% of C, from 0.4% to 1.5% of Mn, preferably less than 1% of Mn, from 0 to 2.5% of Cr, preferably between 0.25 and 1.3%, from 0.1% to 0.6% of Si, from 0 to 1% of Mo, at most 0.50% of Ni, at most 0.02% of S and P, and preferably S less than or equal to 0.005%.

According to a variant of this invention, the content of carbon C can be greater than or equal to 0.08%, preferably greater than or equal to 0.12%, and the steel can contain at most 0.4 of Si.

The tempering of the steel of the tempered martensite-bainite type, can be more or less pronounced, in particular by such as stress-relief tempering, so that the wire that is obtained has the necessary ductility to be subsequently used as a reinforcement wire, or such as quality tempering that makes the wire suitable for use in the presence of $H_2S$.

Preferably, the martensite-bainite structure is predominantly martensite, with a percentage of between 0 and 50% of lower bainite, or predominantly lower bainite with a percentage of between 0 and 50% of martensite. Preferably, the structure can contain only a small quantity of ferrite. The wire can have a hardness of greater than 20 HRC. Preferably, the size of the austenitic grain is located between the indices 5 and 12, and advantageously between indices 8 and 11, according to standard NF 04012.

The shaping wire can have a section that has at least one of the following general shapes: U-shaped, T-shaped, Z-shaped, rectangular, or round.

The section of the shaping wire can have a width L and a thickness e, and can have the following proportions: L/e greater than 1 and less than 7. The thickness can vary between 1 mm and 20 mm, and can reach 30 mm.

The profile of the shaping wire can comprise means for hooking to an adjacent wire.

In a first variant of the shaping wire according to this invention, carbon content C can be less than or equal to 0.45%, and the steel contains at least one of the two following alloying elements, in a small quantity:

between 0.1% and 2.5% of Cr, preferably between 0.25 and 1.3%, between 0.1% and 1% of Mo.

In another variant of the shaping wire according to the invention, the carbon content of the steel can be greater than or equal to 0.4%, while remaining less than 0.8%, and can correspond to a standard hard or medium-hard carbon-manganese steel that is traditionally used in wire-drawing or cable-making, without adding an alloying element such as Cr or Mo, optionally with a small quantity of dispersoid. Such steels can be found in steel range FM40 to FM80, according to the AFNOR standard.

According to a first embodiment, the shaping wire according to the invention can have an HRC hardness of greater than or equal to 32, preferably greater than or equal to 35. The wire that is thus obtained may not be suitable for withstanding $H_2S$ under certain operating conditions, but can be used in a very advantageous way as a reinforcement wire for hoses thanks to its excellent optimized mechanical properties, in particular by the combination of high mechanical strength and ductility that is greater than that which can be obtained with the known processes. Breaking point Rm can reach 1000 to 1600 MPa, preferably greater than or equal to 1200 MPa. Such a wire can be advantageously used to provide the reinforcement for hoses that are intended for transporting weakly corrosive crude oil ("sweet crude"), degassed petroleum ("dead oil"), or water. The process for producing such a wire can end with a quenching operation, preferably followed by stress-relief annealing.

According to another embodiment, the shaping wire according to the invention can have an HRC hardness of greater than or equal to 20, preferably less than or equal to 35. The wire that is thus obtained can have properties of resistance to $H_2S$ under the operating conditions described above, in particular following HIC tests in a very acidic environment (pH of close to 2.8 or 3). Mechanical strength Rm can be on the order of 700 to 900 MPa with a pH of close to 3 and can reach at least 1100 MPa with a higher pH. The stress that is applied in the SSCC tests according to NACE, with a pH of close to 2.8, can be at least 400 MPa and can reach 600 MPa.

In the case where the SSCC tests are carried out with a pH that is greater than 3, the acceptable stresses can be higher and can reach about 90% of the yield point.

To use them as reinforcement wires of hoses that are intended for transporting crude oil that contains acid gas, in particular $H_2S$ and $CO_2$, the process according to the invention makes it possible to produce shaping wires of steel of the tempered martensite-bainite type, whose structure has extremely fine carbide nodules in a state of very high dispersion in a ferrite matrix that is produced by tempering of a martensite-bainite structure. It is advantageous to compare this steel to other steels that have already been proposed or used to produce reinforcement wires that are intended for the same application, such as steels that are obtained by spheroidization treatment from a cold-hardened ferrite-pearlite structure, whereby these steels generally contain carbide elements in a ferrite matrix. The spheroidized carbide elements of these steels are considerably less fine and less dispersed than in the case of the steel according to the invention, which makes it possible to identify clearly the difference between the two types of material. It also seems that the superior properties of the shaping wire according to the invention, in terms of mechanical strength and compatibility with $H_2S$, compared to wires of the prior art, in particular a spheroidized steel, may be associated with the fact that they have a much finer and more dispersed nodular structure.

It should be noted that the invention has particularly the advantage that from the same lots of hot-rolled rods and by performing the same quenching operations and optionally stress relief operations, it is possible to produce, depending on the requirements, either steel wires that are very strong mechanically but that sometimes do not have the required properties of resistance to $H_2S$, or wires that are resistant to $H_2S$ even under the harshest conditions. In the first case, the routing ends with the quenching operation, preferably followed by stress relief. In the other case, the routing continues with an additional stage of final tempering.

The invention can be applied to a hose for the transport of an effluent that contains $H_2S$, whereby the tube can comprise at least one armor layer for reinforcement to pressure and/or traction that contains shaping wires according to the invention.

This invention will be better understood and its advantages will be identified more clearly from reading the following examples, which are by no means limiting.

EXAMPLE 1

Shaping wires with a circular section that has a diameter of 15 mm have been produced from a steel of the chromium-molybdenum type in accordance with grade 30CD4 of the AFNOR standard (equivalent to ASTM standard 4130 associated with the number UNS G41300). The steel that is used has the following composition:

C: 0.30% Mn: 0.46% Cr: 0.90% Si: 0.32% Mo: 0.18% Ni: 0.12% S=0.003% P=0.009%

The quenching operation was carried out in a bath at a speed of 1.8 m/minutes with high-frequency induction heating at 980° C.–1000° C., then oil quenching. Stress-relief annealing was performed in a furnace for 2 hours at 180° C.

After these thermal treatments of quenching and stress relief, the hardness of the wire is 40 HRC (Rm=1200 MPa), and its structure is primarily martensite. The size of the grains corresponds to index 8 of standard NF 04.102.

Thermal tempering treatments in a furnace for 2 hours result in the following mechanical characteristics:

| Temp. (° C.) | 600 | 620 | 645 | 655 | 675 |
|---|---|---|---|---|---|
| HRC hardness | 30 | 28 | 26 | 24 | 22 |

Wires that are thus heat-treated and that have a hardness of between 22 and 26 HRC satisfy the SSC NACE TM 0177 tests for 30 days under the following uniaxial tensile strengths (T):

| Tensile stress | | Characteristics of the steel (depending on tempering) | |
|---|---|---|---|
| T (MPa) | HRC | Re (MPa) | Rm (MPa) |
| 500 | 22 | 650–680 | 760–800 |
| 550 | 24 | 680–700 | 800–830 |
| 450 | 26 | 700–750 | 830–860 |

After these NACE tests, tensile strength tests on test pieces show that the mechanical characteristics and particularly the elongation at fracture are not affected but remain very close to the values that are obtained before the NACE test.

HIC tests that are carried out according to the NACE TM 0284 procedure, but in a so-called "NACE TM 0177" type of solution (pH=2.8) instead of synthetic sea water (pH of about 5), reveal insensitivity to stepwise cracking for these three hardness levels (22, 24 and 26 HRC):

CLR=0% CTR=0% CSR=0%

Moreover, the welds that are produced by induction or resistance heating, with axial compression, supplemented by tempering treatment of less than 5 minutes, pass the SSC NACE TM 0177 test under a uniaxial tension of 400 MPa. Preferably, the post-welding tempering temperatures should be greater than that of the tempering treatment of the metal and less than the temperature of the beginning of austenitization AC1, preferably less than 20 to 30° C. relative to AC1.

In the industrial production of hoses, such welding operations are essential to connect the unit sections of wires. It should be noted that it is particularly advantageous to obtain good results in the NACE tests on the wires and also to ensure the possibility of carrying out the tempering operation quickly after welding. It has been found, for example, that the time that such tempering treatment takes exceeds 30 minutes in the case where the steel contains more than 0.10% of vanadium and that, consequently, the use of this steel is not recommended for applications that are targeted by this invention, whereas, at first glance, it would seem obvious to resort to adding vanadium for a use of this type.

From a slightly different steel, also of 30CD4 type, and having the following composition:

C=0.31%, Mn=0.66%, Si=0.23%, Cr=1.02%, Mo=0.22%, Ni=0.24%, S=0.010%, P=0.009%, a wire that has a T-shaped section (height 14 mm, width 125 mm) was produced. After a quenching operation in a bath and stress-relief annealing, the wire has a hardness of 40 HRC.

After tempering in a furnace for about 3 hours at a temperature that is close to 650° C., the following mechanical characteristics are obtained as a function of hardnesses of between 23 and 25 HRC:

| HRC | Re (MPa) | Rm (MPa) |
|---|---|---|
| 23 | 675 | 790 |
| 24 | 715 | 815 |
| 25 | 740 | 854 |

The HIC tests that are carried out for the round wire with a diameter of 15 mm show the same results, with no cracking.

The SSCC test provide at least one uniaxial tension value of 400 MPa for each of the hardnesses.

EXAMPLE 2

Shaping wires have been produced from a steel of the chromium-molybdenum type in accordance with grade 12CD4 defined by the AFNOR standard that contains:

C: 0.14% Mn: 0.74% Cr: 1.095% Si: 0.203% Mo: 0.246% Ni: 0.24% S=0.006% P=0.008%

From round hot-rolled rods that are 8 mm in diameter (that has a fracture stress of about 750 MPa), a flat wire that has a width of 9 mm and a thickness of 3 mm (9×3) was obtained by wire-drawing and cold rolling.

Quenching was carried out with oil in a bath, followed by stress-relief tempering in a lead bath at a temperature of close to 500° C. A hardness of 40 HRC and a fracture stress of 1240 MPa are obtained. The size of the grains corresponds to index 8 of standard NF 04.102.

Tempering treatment in the furnace:

The table below makes it possible to compare the mechanical characteristics of the wires before and after the HIC test that is carried out according to the NACE TM 0284 procedure but in a so-called "NACE TM 0177" solution (pH=2.8) instead of synthetic sea water (pH of about 5):

| | HRC | | Re | Rm | A (%) | Z (%) |
|---|---|---|---|---|---|---|
| | | After stress relief, before final tempering: | | | | |
| | 40 | before HIC | 1140 | 1230 | 18 | 81 |
| | | after HIC | 1100 | 1177 | 18.4 | 77 |
| | | After final tempering: | | | | |
| 570° C. | 28 | before HIC | 790 | 850 | 24 | 85 |
| | | after HIC | 800 | 861 | 22 | 67 |
| 600° C. | 26 | before HIC | 740 | 830 | 26 | 66 |
| | | after HIC | 750 | 792 | 23 | 72 |
| 630° C. | 24 | before HIC | 720 | 796 | 28 | 64 |
| | | after HIC | 670 | 746 | 24 | 70 |
| 640° C. | 22 | before HIC | 700 | 781 | 30 | 82 |
| | | after HIC | 640 | 731 | 24 | 76 |

The wires after tempering treatment that is adjusted to obtain 24 HRC passed the tests according to the NACE TM 0177 procedure (method A) under 500 MPa of stress.

Tempering treatment in a bath:

The tempering was carried out at a speed of 15 m/minute by medium-frequency induction heating at different powers that result in the following mechanical characteristics depending on the temperature that is measured at the outlet of the heating reactor.

| T reactor outlet (° C.) | 680 | 700 | 710 |
|---|---|---|---|
| HRC hardness | 29 | 28 | 26 |

In the two cases of tempering treatment (tempering in the furnace or in a bath), HIC tests are carried out for each hardness level, according to the NACE TM 0284 procedure, but in a so-called "NACE TM 0177" type solution (pH=2.8) instead of synthetic sea water (pH of about 5). The tests reveal insensitivity to stepwise cracking for different hardness levels (from 22 to 28 HRC for treatment in the furnace and 26 to 29 for treatment in a bath):

$$CLR = 0\% \qquad CTR = 0\% \qquad CSR = 0\%$$

EXAMPLE 3

Carbon-manganese steels with the addition of between 0.1 and 1% chromium, suitable for quenching and in tempering, in accordance with the range 20C4 to 40Cl according to the AFNOR standard.

1. In the 35Cl grade (0.35 of C), rectangular shaping wires (9×3) are produced with a steel that has the following composition:

C=0.35%, Mn=0.75%, Si=0.26%, Cr=0.35% S=0.02%, P=0.02%, without the addition of either molybdenum or nickel.

After oil quenching and stress-relief annealing, wires with a hardness of 40 HRC and Rm=1310 MPa are obtained. The size of the grains corresponds to index 8 of standard NF 04.102.

Tempering treatment in a furnace:

During a treatment of about one hour at the following temperatures, the following hardnesses are obtained:

| Tempering temperature | 450° C. | 500° C. | 550° C. | 600° C. |
|---|---|---|---|---|
| HRC | 27.3 | 27.2 | 26.1 | 22 |

After HIC tests according to the NACE TM 0284 procedure but in a so-called "NACE TM 0177" procedure (pH=2.8) instead of synthetic sea water (pH of about 5), the following mechanical characteristics are obtained compared to those that are measured before HIC:

| HRC | | Re | Rm | A (%) |
|---|---|---|---|---|
| 27 | before HIC | 730 | 890 | 16 |
| | after HIC | 730 | 890 | 14.5 |
| 22 | before HIC | 705 | 780 | 18 |
| | after HIC | 710 | 780 | 20 |

Tempering treatment in a bath:

For a temperature of 700° C., the wire that is obtained has a hardness of 27.5 HRC, Re=710 MPa, Rm=940 MPa and A=14.6%.

In the two cases of tempering treatment, the HIC tests that are carried out according to the NACE TM 0284 procedure but with an a so-called "NACE TM 0177" type solution (pH=2.8) instead of synthetic sea water (pH of about 5) reveal insensitivity to stepwise cracking for hardness levels of between 22 and 27 HRC.

In the case of tempering treatment in a bath (HRC=27.5), the SSC NACE TM 0177 tests (method A) are passed under an axial tension of 400 MPa.

2. Tests are carried out on a rectangular shaping wire 9×3 that is produced from a steel in accordance with grades 18C4 or 20C4 according to the AFNOR standards. The composition contains:

C: 0.18%-Mn: 0.85%-Si: 0.11%-Cr: 0.91 -Ni: 0.174%-Mo: 0.039%-S and P=0.015%.

Oil quenching is carried out, followed by stress-relief annealing, to obtain a hardness of 39 HRC and Rm=1180 MPa. The size of the grains corresponds to an index 8 of standard NF 04.102.

Tempering in a furnace for about 4 hours was carried out at temperatures of 510° C., 525° C. and 540° C. to obtain hardnesses of, respectively, 26, 24 and 22 HRC.

The HIC tests, carried out in a so-called "NACE TM 0177" solution (pH=2.8) instead of synthetic sea water (pH of about 5), provide the same satisfactory results as above.

The SSCC test is passed according to the hardnesses (22 to 26 HRC) under a stress of between 400 and 450 MPa.

For a round wire that has a diameter of 13 mm, in the same steel and following equivalent treatments, it is possible to provide the mechanical characteristics as a function of hardnesses:

| HRC | Re (MPa) | Rm (MPa) |
|---|---|---|
| 23 | 700 | 790 |
| 24 | 720 | 805 |
| 25 | 740 | 825 |

3. Using a variant of the grade with 0.35% of C that is described above, shaping wires that have a thickness of between 2 and 7.5 mm and a width of between 5 and 15 mm are produced with a steel that has the following composition:

C=0.33%, Mn=0.73%, Si=0.21%, Cr=0.34% S=0.015%, P=0.007%.

After water quenching and stress-relief annealing, wires with a hardness of 380 Vickers (40 HRC) and Rm=1400 MPa are obtained. The size of the grains corresponds to an index 1 of standard NF 04.102.

After tempering treatment in a furnace at 615° C. for 15 minutes (equivalent result can be obtained by treatment at 680° C. for about 1 minute), a final wire is obtained that has an HRC hardness of 24, with a breaking point of Rm=828 MPa and a yield point of $R_{PO.2}$=724 MPa. The HIC type tests have shown that this wire is not sensitive to cracking in the presence of $H_2S$, whereby the tests were conducted according to the NACE standard TM 0284, but in a solution according to NACE TM 0177 with pH=2.7.

Corrosion tests under SSCC type stress according to NACE standard TM 0177 were able to reach a period of 720 hours without the appearance of either rupturing or cracking. In one case, the stress reached 90% of the yield point, or 652 MPa, with the pH being equal to 3.5. In another case, the pH was at a very low value of 2.7, with the stress that was applied being 600 MPa or 83% of the yield point.

We claim:

1. A process for the production of a steel wire that is suitable for use as a reinforcement wire of a hose, characterized in that it comprises the following stages:

an elongated shaping wire is produced by rolling or drawing from a steel that contains the following elements:

from 0.05% to 0.8% of C, from 0.4% to 1.5% of Mn, from 0 to 2.5% of Cr, from 0.1% to 0.6% of Si, from 0 to 1% of Mo, at most 0.50% of Ni, at most 0.02% of S and P, at least one thermal treatment that comprises at least one quenching operation of the shaping wire is carried out under conditions that are defined to obtain an HRC hardness of greater than or equal to 32, and a steel structure of said wire that is at least 90% martensite-bainite, with said wire having a breaking point $R_m$ which does not exceed 1600 MPa after the thermal treatment, wherein said quenching comprises passing said wire through an austenitizing furnace at a temperature that is greater than point AC3 of the steel.

2. A process according to claim 1, wherein the hardness after said first thermal treatment is greater than or equal to 35 HRC.

3. A process according to claim 1, wherein the shaping wire is obtained by cold transformation of hot-rolled rods and wherein said hot-rolled rods are produced and/or heat-treated to obtain an Rm value that is less than about 850 MPa.

4. A process according to claim 1, wherein the shaping wire is obtained directly by hot rolling, optionally followed by a soft annealing operation in order to obtain an Rm value of said shaping wire that is less than about 850 MPa.

5. A process according to claim 1, wherein the quenching operation is carried out continuously in a bath.

6. A process according to claim 1, wherein said first thermal treatment comprises stress-relief annealing in addition to said quenching.

7. A process according to claim 6, wherein said stress-relief annealing is carried out in a coil in a furnace.

8. A process according to claim 6, wherein said quenching and said stress-relief annealing are carried out in a bath.

9. A process according to claim 1, wherein said steel contains:

at most 0.45% of C, and at least one of the two following elements:

between 0.1% and 2.5% of Cr, between 0.1% and 1% of Mo.

10. A process according to claims 1, wherein said steel contains:

between 0.40% and 0.8% of C, and no significant quantity of Cr and Mo.

11. A process according to claim 1, wherein said quenching further comprises moving the shaping wire to a quenching zone with a fluid with a quenching intensity that is matched to the grade of the steel and the size of the wires.

12. A process according to claim 6, wherein the temperature of said stress-relief annealing is:

between 300 and 550° C. in a treatment in a stream, between 150 and 300° C. in a treatment in a coil in a furnace.

13. A process according to claim 1, wherein it comprises, after a first thermal treatment, a final thermal tempering treatment under conditions that are adjusted to obtain a hardness that is greater than or equal to 20 HRC and less than or equal to 35 HRC.

14. A process according to claim 13, wherein the hardness is less than or equal to 28 HRC.

15. A process according to claim 13, wherein the final tempering is carried out in a bath.

16. A process according to claim 13, wherein the final tempering is carried out in a coil in a furnace.

17. A process according to claim 13, wherein the temperature of said final tempering is at most equal to a temperature that is about 10° C. to 30° C. below the AC1 temperature of the beginning of austenitization of the steel.

18. Elongated shaping wire having a constant cross section, produced from a steel that contains the following elements:

from 0.05% to 0.8% of C, from 0.4% to 1.5% of Mn, from 0 to 2.5% of Cr, from 0.1% to 0.6% of Si, from 0 to 1% of Mo, at most 0.50% of Ni, at most 0.02% of S and P, and wherein it has a structure at least 90% martensite-bainite, and a breaking point $R_m$ which does not exceed 1600 MPa.

19. Shaping wire according to claim 18, wherein it has an HRC hardness that is greater than or equal to 20.

20. Shaping wire according to claim 18, wherein said steel contains:

at most 0.45% of C, and at least one of the following elements:

between 0.1% and 2.5% of Cr, between 0.1% and 1% of Mo.

21. Shaping wire according to claim 18, wherein said steel contains:

between 0.40% and 0.8% of C, and no significant quantity of Cr or Mo.

22. Shaping wire according to claim 18, wherein it has a hardness that is greater than or equal to 32 HRC, an Rm value that is greater than 1000 MPa, and an elongation at fracture that is greater than or equal to 5%.

23. Shaping wire according to claim 18, wherein it has a hardness that is greater than or equal to 20 HRC and less than or equal to 35 HRC and an Rm that is greater than 700 MPa.

24. Shaping wire according to claim 18, wherein said section has a width L and a thickness e, and wherein it has the following proportions: L/e greater than 1 and less than 7, with e being less than or equal to 30 mm.

25. Shaping wire according to claim 18, wherein the profile of the section comprises means for hooking to an adjacent wire.

26. Hose for transporting an effluent that contains $H_2S$, wherein it comprises at least one armor layer for reinforcement in pressure and/or traction that comprises shaping wires according to claim 18.

27. A process according to claim 1, wherein said steel contains 0.08% to 0.8% of C and Si that is less than or equal to 0.4.

28. A process according to claim 27, wherein said steel contains 0.12% to 0.8% of C.

29. Shaping wire according to claim 18, wherein said steel contains 0.08% to 0.8% of C and Si that is less than or equal to 0.4.

30. Shaping wire according to claim 29, wherein said steel contains 0.12% to 0.8% of C.

31. A shaping wire according to claim 18 having not more than 1% of ferrite in the microstructure thereof.

* * * * *